United States Patent [19]

Garvare et al.

[11] 4,178,178

[45] Dec. 11, 1979

[54] METHOD OF SEALING HOT ISOSTATIC CONTAINERS

[75] Inventors: Tore Garvare; Sven-Erik Isaksson, both of Robertsfors, Sweden

[73] Assignee: ASEA AB, Vasteras, Sweden

[21] Appl. No.: 856,535

[22] Filed: Dec. 1, 1977

[30] Foreign Application Priority Data

Dec. 1, 1976 [SE] Sweden ..... 7613445

[51] Int. Cl.[2] ..... B22F 3/00; B22F 3/16

[52] U.S. Cl. ..... 75/226; 75/214

[58] Field of Search ..... 75/226, 214

[56] References Cited

U.S. PATENT DOCUMENTS

| | | | |
|---|---|---|---|
| 3,627,521 | 12/1971 | Vordahl | 75/226 |
| 3,824,097 | 7/1974 | Smythe et al. | 75/226 |
| 3,899,821 | 8/1975 | Ito et al. | 75/226 |
| 3,986,870 | 10/1976 | Danieli et al. | 75/226 |

*Primary Examiner*—Brooks H. Hunt

*Attorney, Agent, or Firm*—Watson, Cole, Grindle & Watson

[57] ABSTRACT

Disclosed is a method and structure for manufacturing solid bodies from a quantity of powder. The powder is preformed and the preform is enclosed in a casing provided with an evacuation nozzle. The preform and the casing are preheated and the preform is degassed by evacuating the casing through the nozzle after the casing has been appropriately evacuated. The nozzle is then sealed by heating the same to forging temperatures, compressing the end thereof which is remote from the casing, cutting the compressed end of the nozzle to present a straight edge and thereafter welding the nozzle shut along said edge. After the nozzle has been sealed the same is enclosed in and surrounded by a gas tight hood and the space between the hood and the nozzle is filled with a fill material which may be a powder, an annular solid body or a combination of such body and a quantity of powder. After the nozzle has been appropriately shielded and covered by the hood and fill material, the casing with the powder preform therein is placed in a high pressure furnace where the preform is subjected to isostatic high pressure hot pressing.

5 Claims, 2 Drawing Figures

METHOD OF SEALING HOT ISOSTATIC CONTAINERS

BACKGROUND OF THE INVENTION

1. Field of the Invention

The present invention relates to a method and to structure useful in manufacturing solid products by bonding or sintering powder preforms into solid bodies by isostatic hot pressing of the powder under high pressure.

2. Description of the Prior Art

During sintering a powder billet or preform is generally enclosed in a metal casing and is subjected simultaneously to an elevated all encompassing pressure and a high temperature in a pressing furnace. Prior to or in connection with the heating of the preform to said high temperature, the powder preform is normally degassed. Such degassing usually is accomplished at a very low pressure and for this purpose it is conventional to connect the casing which contains the powder body to a vacuum pump.

The present invention is of particular interest in the manufacture of billets of materials such as high-speed type steels or so-called superalloys, which billets may be further machined into a desired shape by rolling, forging, machining or the like. Procedures for the pressure sintering of powder preforms into dense, homogeneous solid bodies are described in greater detail in U.S. Pat. No. 3,893,852, the entirety of which is hereby incorporated herein by reference.

In the past, it has been noted that the heating time for large billets may be as much as 5 to 20 hours. During heating the casing rapidly reaches the highest permissible temperature which may be used for the particular enclosed powder and the casing is then maintained at such temperature to achieve heating throughout the powder in the shortest possible time. The casing must be maintained at these high temperatures for the long periods necessary to achieve sintering of the powder and such intense heat treatment often results in changes in the properties of the casing material. Moreover, when the hot casing is subjected to the effect of oxygen, for example when the hot casing is transferred from a preheat furnace to a pressure furnace, significant changes in casing material properties are often experienced. These changes which often result in leakage during hot pressing operations are severe at or near the nozzle which is generally provided on the casing to facilitate the evacuation of the casing during degassing of the powder preform. Thus, the risk of leakage during hot pressing is particularly great at or near the evacuation nozzle.

In addition to the foregoing, the considerable deformation of the nozzle and the welding of the same during sealing prior to hot pressing often results in grain enlargement in the casing material and cracks initiated at the grain boundaries spread and intensify under subsequent influence of harmful gases such that the casing deteriorates to permit pressurized gas to leak thereinto. Since the nozzle is normally not entirely filled with powder below the point of sealing, when the unfilled nozzle is flattened under the influence of the gas pressure during the hot pressing operation, a great deformation may result leading to fractures and ultimately to leaks through the influence of harmful gases. Needless to say, gas leaking into the casing during hot isostatic pressing will prevent the appropriate compression of the powder and will thus interfere with the complete sintering together of the powder grains. The products thus produced will be unsuitable for use because of the remaining porosity and the same will have to be discarded.

SUMMARY OF THE INVENTION

According to the invention, the above-mentioned problems of leakage are minimized if not eliminated entirely by sealing the evacuation nozzle which is connected to the casing after the powder preform has been degassed by evacuation of the casing. The sealed nozzle is then surrounded by a gas tight hood element and the space between the nozzle and the hood element is filled with a filling material. The nozzle may preferably be sealed by heating the same to a high temperature, compressing the outer end thereof, cutting the compressed end to present a straight edge and welding said edge together.

The filling material should have a high density so that the deformation of the hood during pressing will not be great. In this regard the filling material may consist of a metallic or a ceramic powder compacted to the greatest possible density or it may consist of an annular solid body. In the latter case, a powder may also be used to fill up any voids which remain within the hood, either between the filling body and the nozzle or between the filling body and the hood. The hood protects the nozzle, which may have been weakened by heating and sealing operations, from the direct influence of the pressure gas used during hot isostatic pressing and prevents harmful constituents in the pressure gas from intensifying cracks which may be present in the walls of the nozzle to the extent that the nozzle is broken to admit gas into the casing. Furthermore, the hood acts as a second gas barrier consisting of a new material which has not been weakened either by heating or considerably deformation. The filling material limits the extent of deformation of the hood. Manifestly, through the use of the present invention, the deformation of the nozzle will be much smaller and more uniform than in the case where a poorly filled nozzle has been flattened during the hot pressing.

The invention will be described in greater detail with reference to the accompanying drawing.

DETAILED DESCRIPTION OF THE INVENTION

Figure 1:
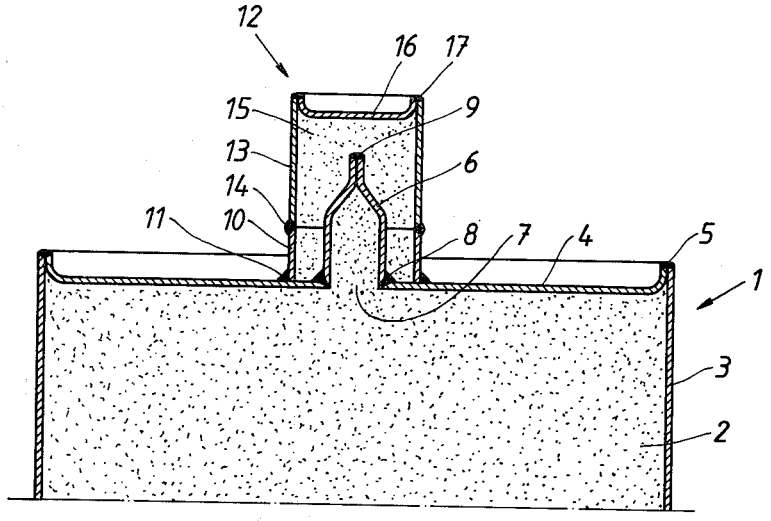
FIG. 1 is a cross-sectional partial elevational view illustrating an isostatic hot pressing casing having an evacuation nozzle which has been sealed and protected in accordance with one embodiment of the present invention.
Figure 2:
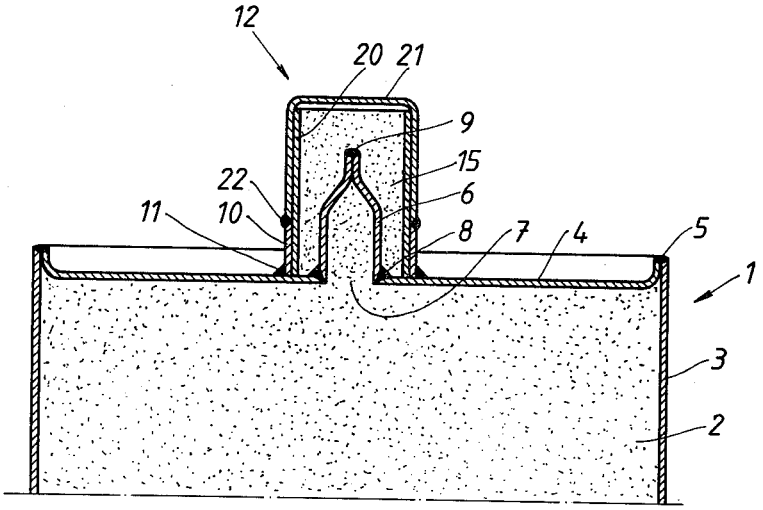
FIG. 2 is a view similar to FIG. 1 but illustrating another embodiment of the invention.

In FIGS. 1 and 2, the reference numeral 1 designates a casing which is filled with a powder preform 2 to be hot pressed. Casing 1 consists of a sheet-metal cylinder 3, a lid 4 which is connected in a gas-tight manner to cylinder 3 by weld 5, and a bottom (not shown). An evacuation tube or nozzle 6 is joined to lid 4 in a gas-tight manner by weld 8 disposed around an opening 7. After the evacuation of the casing and the resultant degassing of enclosed powder preform 2, evacuation tube 6 may be heated to a temperature suitable for deformation and then flattened and cut. In connection with the foregoing it should be noted that prior to such flattening, the casing may be filled with a harmless gas. After cutting, tube 6 may be welded at the point of cutting by a weld 9 so that the seal is rendered permanently gas-tight. The flattening of nozzle 6 involves much stressing of the material thereof and as a result there is a risk that cracks may form therein during the time required for heating casing 1 to the pressing temperature. To alleviate this risk, casing 1 is provided with a ring 10 which is joined to lid 4 in a gas-tight manner by weld 11. The purpose of ring 10 is to facilitate the connecting of a hood 12 to casing 1.

In the embodiment illustrated in FIG. 1, after the cutting and the welding of evacuation nozzle 6, a cylindrical tube 13 is first joined to ring 10 in a gas-tight manner by a weld 14. Thereafter the space between evacuation nozzle 6 and ring 10 and tube 13 is filled with a powder 15. Then tube 13 is sealed by a lid 16 joined thereto by a weld 17.

In the embodiment illustrated in FIG. 2, a cylindrical tube 20 is inserted into ring 10 and the space between tube 20 and evacuation nozzle 6 is filled with powder 15. Thereafter a cap 21 is installed over tube 20 and is joined to ring 10 by a weld 22.

The hood over the evacuation nozzle provides a second gas barrier to considerably reduce the risk of leakage of pressurizing gas into the casing during hot pressing. After the hood has been filled with the filling material, the voids between the powder grains may also be filled with an inert gas. Thus, the sealed evacuation nozzle is protected during heating of the casing to minimize the risk that atmospheric components around the casing might interact with the material of the evacuation nozzle during such heating to cause or extend cracks at or near the point of sealing. On the other hand if, in spite of all, leakage should occur, only a very limited leakage of gas will occur into the space between the evacuation nozzle and the hood. Moreover, if in addition to the fill material the hood is filled with a harmless gas, such leakage will have no significance at all.

The powder in the hood around the evacuation nozzle serves to limit the deformation of the hood so that it, and/or its welds, will not break. The powder used as the filling material in the hood may be a metal powder, a ceramic powder or an $Al_2O_3$ powder, and might be, for example, the same powder as is being sintered in casing 1. The powder should desirably have a fill factor of at least 50% to minimize the deformation of the hood and/or the nozzle.

We claim:

1. In a method for manufacturing solid bodies by preforming a quantity of powder and enclosing the powder preform thus produced in a casing provided with an evacuation nozzle, preheating the powder preform and degassing the same by evacuating said casing through said nozzle, and then isostatically hot pressing the powder preform by subjecting the same simultaneously to an elevated all encompassing gas pressure and a high temperature whereby the powder preform is sintered and compressed to produce a high density solid body, the improvement comprising conducting, after said degassing step and prior to said hot pressing stel, the steps of:

sealing said nozzle;

partially surrounding said sealed nozzle with a hood element so as to define a space between said nozzle and said hood element;

filling the space with a filling material and closing the hood element about the nozzle to yield a gas-tight hood.

2. A method as set forth in claim 1 wherein said nozzle is sealed by heating the same to a high temperature, compressing the outer end thereof, cutting the compressed end to present a straight edge and welding said edge.

3. A method as set forth in claim 1 wherein said filling material comprises a powder.

4. A method as set forth in claim 1 wherein said filling material comprises an annular solid body.

5. A method as set forth in claim 1 wherein said filling material comprises an annular solid body and a quantity of powder filling any remaining voids within said hood element.

* * * * *